US009039143B2

(12) United States Patent
Chida et al.

(10) Patent No.: US 9,039,143 B2
(45) Date of Patent: May 26, 2015

(54) INK JET RECORDING HEAD AND METHOD FOR MANUFACTURING THE SAME

(71) Applicant: CANON KABUSHIKI KAISHA, Tokyo (JP)

(72) Inventors: Mitsuru Chida, Yokohama (JP); Kenji Fujii, Yokohama (JP); Makoto Watanabe, Yokohama (JP); Toshiaki Kurosu, Oita (JP); Masataka Nagai, Yokohama (JP); Takanobu Manabe, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/231,502

(22) Filed: Mar. 31, 2014

(65) Prior Publication Data

US 2014/0292937 A1 Oct. 2, 2014

(30) Foreign Application Priority Data

Apr. 2, 2013 (JP) ..... 2013-076675

(51) Int. Cl.
*B41J 2/14* (2006.01)
*B41J 2/16* (2006.01)

(52) U.S. Cl.
CPC ..... *B41J 2/14145* (2013.01); *B41J 2/1603* (2013.01); *B41J 2/1628* (2013.01); *B41J 2/1629* (2013.01); *B41J 2/1631* (2013.01); *B41J 2/1643* (2013.01); *B41J 2/1645* (2013.01); *B41J 2/1646* (2013.01); *B41J 2002/14387* (2013.01)

(58) Field of Classification Search
CPC ..... B41J 2002/14491; B41J 2/14072; B41J 2/1623; B41J 2/14233; B41J 2/1631; B41J 2/14427; B41J 2/1628; B41J 2/1639; B41J 2/1642
See application file for complete search history.

(56) References Cited

U.S. PATENT DOCUMENTS

2007/0242108 A1* 10/2007 Inoue ..... 347/65
2008/0180486 A1* 7/2008 Ozaki et al. ..... 347/47

FOREIGN PATENT DOCUMENTS

JP 11-348290 A 12/1999
JP 2007-283501 A 11/2007

* cited by examiner

*Primary Examiner* — Lisa M Solomon
(74) *Attorney, Agent, or Firm* — Canon USA Inc IP Division

(57) ABSTRACT

An ink jet recording head includes a substrate having a plurality of discharge energy generation elements and having an ink supply port, a protective film provided on the substrate and configured to protect wiring connected to the discharge energy generation elements, and an ink discharge port forming member, wherein the protective film has a protruding portion, wherein the ink discharge port forming member has a beam-like protrusion, wherein the beam-like protrusion has a reinforcing rib, and wherein a separation film containing gold is formed at a portion where the protruding portion and the reinforcing rib are held in close contact with each other.

10 Claims, 11 Drawing Sheets

INK JET RECORDING HEAD AND METHOD FOR MANUFACTURING THE SAME

BACKGROUND OF THE INVENTION

1. Field of the Invention

The present invention relates to an ink jet recording head and a method for manufacturing the same.

2. Description of the Related Art

A typical example of a liquid discharge head configured to discharge liquid is an ink jet recording head to which an ink jet recording system is applied. In the ink jet recording system, recording is performed by discharging ink onto a recording medium. The ink jet recording head is generally equipped with ink flow paths, discharge energy generation elements provided at a part of the ink flow paths, and minute ink discharge ports (orifices) for discharging ink by the energy generated by the discharge energy generation elements. Japanese Patent Application Laid-Open No. 11-348290 discusses a bonding method in which, in order to enhance the close contactness between a substrate provided with discharge energy generation elements and a member constituting the wall of liquid flow paths, the substrate and the member constituting the wall of the liquid flow path is bonded through a adhesive layer formed of polyether amide resin. On the other hand, Japanese Patent Application Laid-Open No. 2007-283501 discusses a technique according to which a beam-like protrusion in a common liquid chamber is provided with a reinforcing rib as a method of preventing deformation or separation of a member constituting the wall of an orifice and of a flow path (ink discharge port forming member) as a result of swelling of the member when a liquid discharge head is filled with ink.

SUMMARY OF THE INVENTION

According to an aspect of the present disclosure, an ink jet recording head includes a substrate having a plurality of discharge energy generation elements arranged in two rows and having an ink supply port formed between the rows of discharge energy generation elements, a protective film provided on the substrate and configured to protect wiring connected to the discharge energy generation elements, and an ink discharge port forming member forming an ink flow path communicating with the ink supply port between the ink discharge port forming member and the substrate and having an ink discharge port communicating with the ink flow path at a position corresponding to each of the discharge energy generation elements, wherein the protective film has a protruding portion protruding from the substrate toward the ink supply port side, wherein the ink discharge port forming member has a beam-like protrusion over the ink supply port between the ink discharge port forming member and the substrate, wherein the beam-like protrusion has a reinforcing rib extending toward the substrate side, and wherein a separation film containing gold is formed at a portion where the protruding portion and the reinforcing rib are held in close contact with each other.

According to another aspect of the present disclosure, an ink jet recording head manufacturing method includes forming a discharge energy generation element, an electrode pad, and wiring on a substrate, forming a protective film on the substrate so as to protect the wiring, forming a film containing gold on the electrode pad and on a portion constituting a protruding portion of the protective film, forming an ink discharge port forming member on the substrate, forming an ink supply port in the substrate, and forming an ink flow path.

Further features of the present invention will become apparent from the following description of exemplary embodiments with reference to the attached drawings.

DESCRIPTION OF THE EMBODIMENTS

Figure 1A:
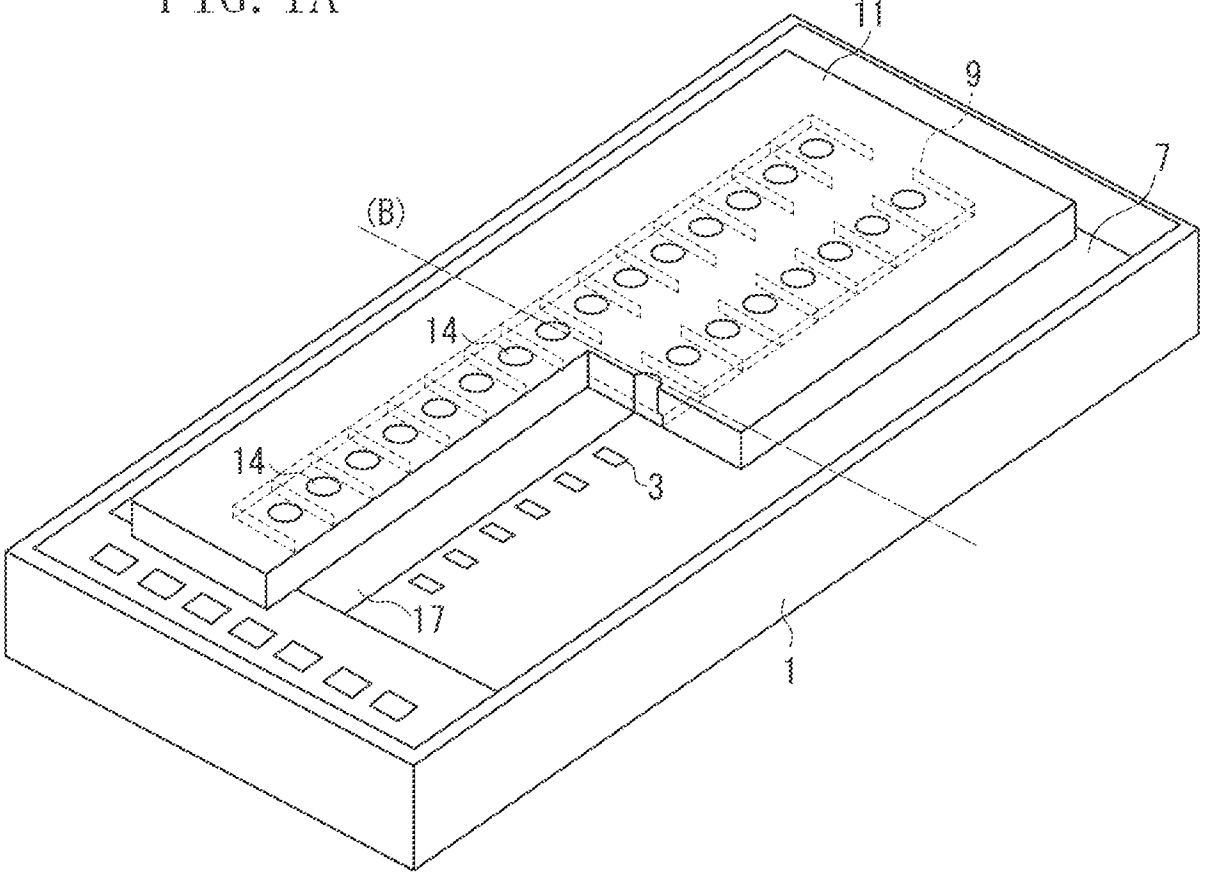
FIGS. 1A, 1B, and 1C are diagrams illustrating an example of an ink jet recording head according to an exemplary embodiment of the present invention.

Due to the recent reduction in size and enhancement in precision of ink jet recording heads, it is difficult to secure the close-contact area between a substrate and a flow path wall. Consequently, the lowering of the close contact strength for an ink discharge port forming member is concerned. From this viewpoint, it is desirable to provide a structure, such as a reinforcing rib, which is discussed in Japanese Patent Application Laid-Open No. 2007-283501. On the other hand, when a tip and a plate are bonded together at the time of mounting, the ink jet recording head requires hydroxyl (OH) groups, so that it is necessary to leave a thermal oxidation film on the back surface of the tip. In the above-described process, a part of the protective film of the wiring remains in the ink supply port while protruding toward the ink supply port side. The protective film protruding toward the ink supply port side has the effect of stabilizing the distance between the ink flow path and the ink discharge port. However, when the beam-like protrusion of the ink discharge port forming member is provided with a reinforcing rib as discussed in Japanese Patent Application Laid-Open No. 2007-283501, the protective film protruding toward the ink supply port side and the reinforcing rib are brought into close contact with each other. In this case, if the ink discharge port forming member swells when the ink flow path is filled with ink, the protective film protruding toward the ink supply port side is raised by the ink discharge port forming member since it is held in close contact with the reinforcing rib. Consequently, in some cases, the protective film may be cracked.

The present disclosure has been made in view of the above problem, and is directed to an ink jet recording head having a reinforcing rib with high reliability for preventing the protective film protruding toward the ink supply port side from cracking.

[Ink Jet Recording Head]

According to an exemplary embodiment, an ink jet recording head includes a substrate having a plurality of discharge energy generation elements arranged in two rows and having an ink supply port formed between the rows of discharge energy generation elements, a protective film provided on the substrate and configured to protect wiring connected to the discharge energy generation elements, and an ink discharge port forming member forming an ink flow path communicating with the ink supply port between the ink discharge port forming member and the substrate and having an ink discharge port communicating with the ink flow path at a position corresponding to each of the discharge energy generation elements, wherein the protective film has a protruding portion protruding from the substrate toward the ink supply port side, wherein the ink discharge port forming member has a beam-like protrusion over the ink supply port between the ink discharge port forming member and the substrate, wherein the beam-like protrusion has a reinforcing rib extending toward the substrate side, and wherein a separation film containing gold is formed at a portion where the protruding portion and the reinforcing rib are held in close contact with each other.

Figure 4A:
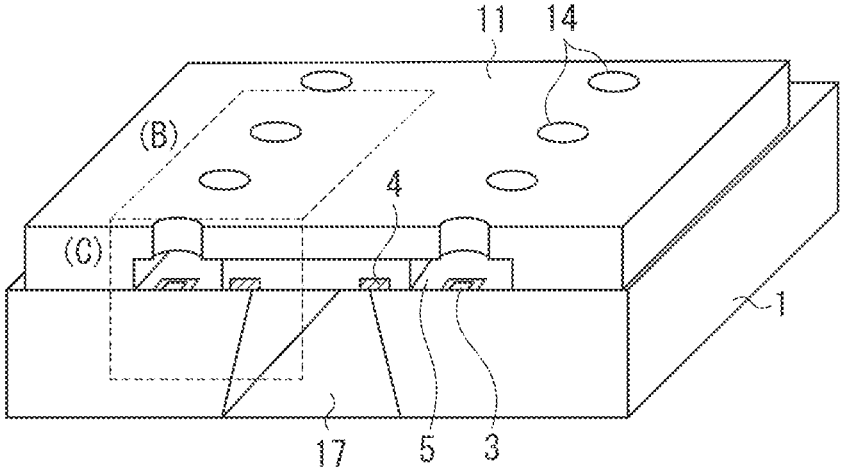
FIGS. 4A, 4B, and 4C are diagrams illustrating an example of an ink jet recording apparatus according to an exemplary embodiment of the present invention.
Figure 4B:
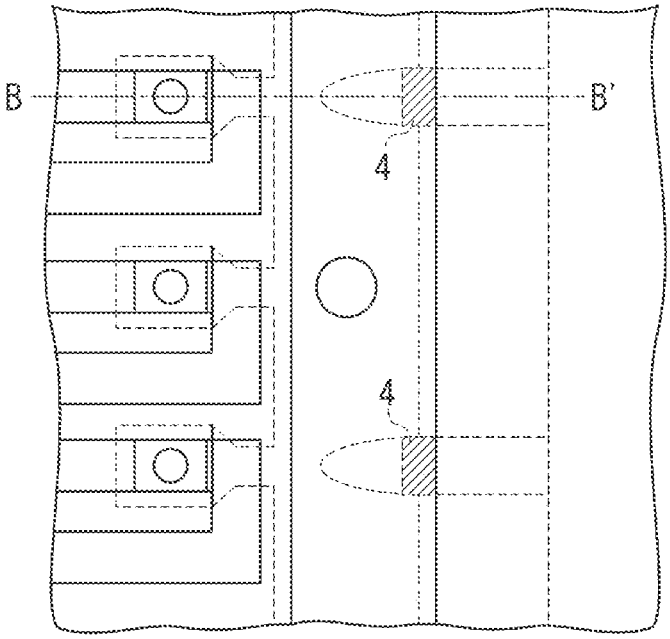
Figure 4C:
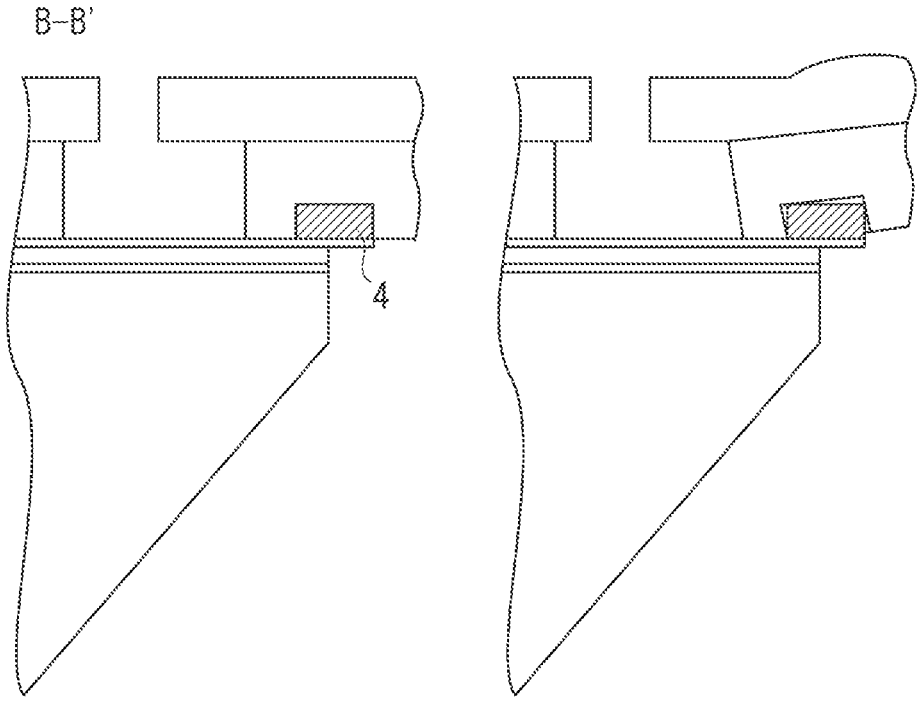

In the ink jet recording head according to an exemplary embodiment, a separation film containing gold is formed between the protrusion of the protective film protruding from the substrate toward the ink supply port side (hereinafter referred to as the protrusion) and the reinforcing rib. As a result, even when the ink flow path is filled with ink, and the ink discharge port forming member swells, the protrusion is protected by the separation film. Further, the separation film containing gold is not held in close contact with the reinforcing rib but held in a separable state. Therefore, as illustrated in FIG. 4C, the separation film and the reinforcing rib are separated from each other when the ink discharge port forming member swells. With the above-described arrangement, no load is applied to the protrusion. Therefore, the protrusion maintains the shape thereof. Thus, it is possible to provide an ink jet recording head applicable to various types of ink in a simple structure while maintaining the desired shape and securing reliability thereof.

Figure 1B:
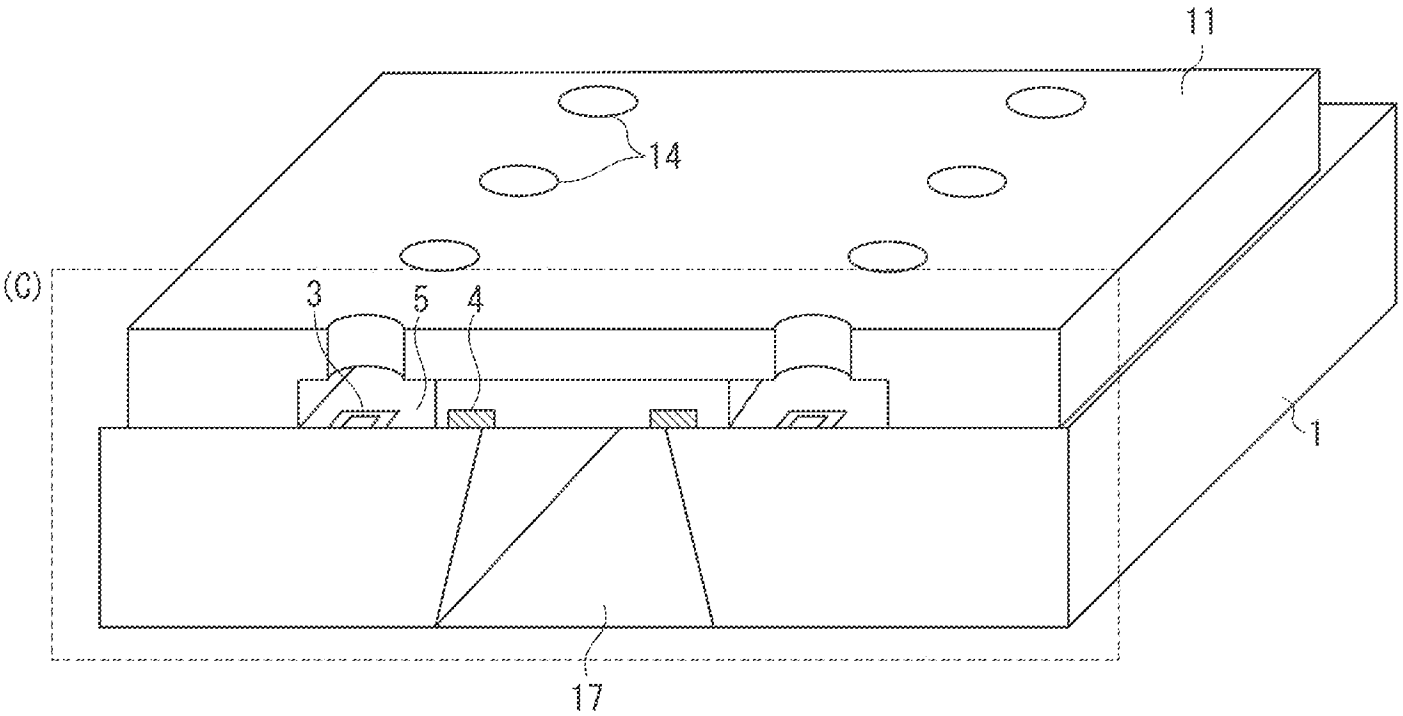
Figure 1C:
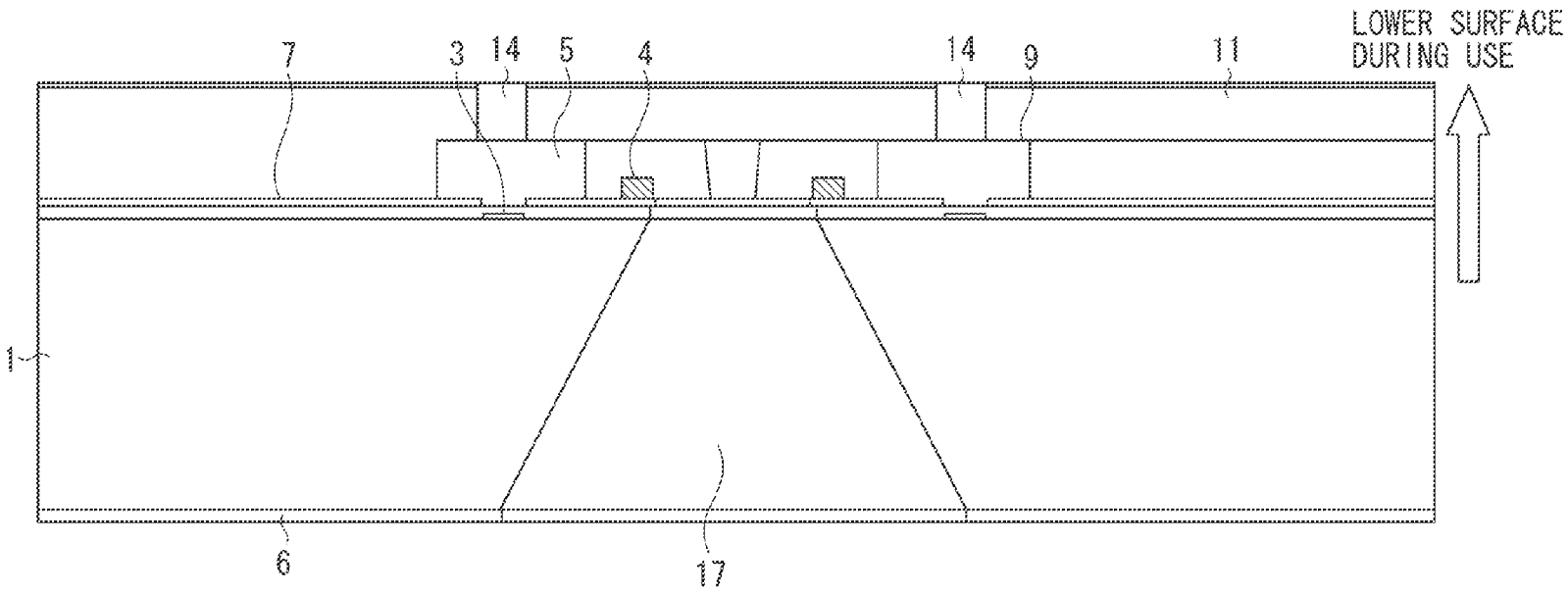

FIGS. 1A, 1B, and 1C illustrate an example of an ink jet recording head according to an exemplary embodiment. FIG. 1A is a perspective view of an ink jet recording head according to the present invention, FIG. 1B is a sectional perspective view of the ink jet recording head of FIG. 1A. FIG. 1C is a sectional view of the ink jet recording head of FIG. 1A. The ink jet recording head according to the present exemplary embodiment is not restricted to the example illustrated in FIGS. 1A, 1B, and 1C.

The ink jet recording head illustrated in FIGS. 1A, 1B, and 1C is equipped with a substrate 1 on which discharge energy generation elements 3 configured to generate the energy for discharging ink are arranged in two rows at a predetermined pitch. A silicon substrate may be employed as the substrate 1. Between the rows of the discharge energy generation elements 3, there is formed an ink supply port 17 so as to extend through the substrate 1. Further, on the surface (hereinafter referred to as the front surface) of the substrate 1 on which the discharge energy generation elements 3 are arranged, there are arranged wiring connected to the discharge energy generation elements 3, and a wiring pad. A gold plating layer is formed on the wiring pad. Further, a protective film 7 is formed in order to protect the wiring. There are no particular limitations regarding the material of the protective film 7. Examples of the material include silicon nitride (SiN), silicon monoxide (SiO), and silicon carbide (SiC). It is possible to employ one, or two or more kinds of these materials. There are no particular limitations regarding the thickness of the protective film 7. The thickness may, for example, be 0.2 μm or more and 1.0 μm or less. The protective film 7 has a protrusion protruding from the substrate 1 toward the ink supply port 17 side. A separation film 4 is formed on the protrusion. The separation film 4 contains gold, and is separable from a reinforcing rib described below. Apart from gold, the separation film 4 may contain stainless steel (SUS), titanium, aluminum or the like. It is desirable for the thickness of the separation film to be 2.0 μm or more and 5.0 μm or less.

On the surface of the substrate 1, there is further formed an ink discharge port forming member 11. The ink discharge port forming member 11 forms an ink flow path 5 communicating with the ink supply port 17 between itself and the substrate 1. Further, the ink discharge port forming member 11 has ink discharge ports 14 for discharging ink at positions facing each of the discharge energy generation elements 3. The ink discharge ports 14 communicate with the ink flow path 5. There are no particular limitations regarding the material of the ink discharge port forming member 11 so long as it is separable from the separation film 4. Examples of the material include photosensitive epoxy resins such as chloroprene rubber (CR) material and SU-8. It is possible to employ one, or two or more kinds of these resins. The ink discharge port forming member 11 has a beam-like protrusion positioned over the ink supply port 17 between itself and the substrate 1. Further, a columnar protrusion may be formed in addition to the beam-like protrusion. A reinforcing rib extending toward the substrate 1 side is formed integrally with the beam-like protrusion. There are no particular limitations regarding the number of reinforcing ribs, and a plurality of reinforcing ribs may be formed for one beam-like protrusion. The material of the reinforcing rib may be the same as the material of the ink discharge port forming member 11. The reinforcing rib is in close contact with the protrusion. In the present invention, the separation film 4 containing gold is formed at the portion where the protrusion and the reinforcing rib are held in close contact with each other. The separation film 4 may be formed under the reinforcing rib, and may be formed on the protective film 7 and at the tip of the ink supply port 17. It is only necessary for the separation film 4 to be formed at least at the portion where the protrusion and the reinforcing rib are held in close contact with each other. The separation film 4 may be formed at a part of the portion where the protrusion and the reinforcing rib are held in close contact with each other, or may be formed on the entire surface of the portion where the protrusion and the reinforcing rib are held in close contact with each other.

Between the substrate 1 and the ink discharge port forming member 11, there may be formed an intermediate layer on the protective film in order to enhance the close contactness between the substrate 1 and the ink discharge port forming member 11. Examples of the material of the intermediate layer include thermoplastic resins, such as polyether amide resin and polyimide resin. It is possible to employ one, or two or more kinds of these resins. Further, a silicon dioxide ($SiO_2$) film 6 is formed on the back surface of the substrate 1.

The ink jet recording head illustrated in FIGS. 1A, 1B, and 1C discharges ink droplets from the ink discharge ports 14 by applying the energy generated by the discharge energy generation elements 3 to the ink filling the ink flow path 5 via the ink supply port 17. The discharged ink droplets adhere to the recording medium, and thereby recording is performed.

The ink jet recording head according to the present invention can be mounted in a printer, a copying machine, a facsimile apparatus having a communications system, an apparatus such as a word processor having a printer unit, and an industrial recording apparatus compositely combined with various processing apparatuses. By using this ink jet recording head, it is possible to perform recording on various recording medium such as paper, thread, fibers, leather, metal, plastic, glass, wood, and ceramics. In the present invention, the term "recording" means not only applying an image with some meaning, such as an image having characters and figures, but also applying an image with no meaning, such as an image having patterns, to a recording material.

[Ink Jet Recording Head Manufacturing Method]

A method of manufacturing an ink jet recording head according to the present disclosure includes (a) forming a discharge energy generation element, an electrode pad, and wiring on a substrate, (b) forming a protective film on the substrate so as to protect the wiring, (c) forming a film containing gold on the electrode pad and on a portion constituting a protrusion of the protective film, (d) forming an ink discharge port forming member in the substrate, (e) forming an ink supply port in the substrate, and (f) forming an ink flow path. According to the above method, it is possible to manufacture an ink jet recording head according to the present invention in a satisfactory yield. In the following, each of the steps will be described in detail with reference to the drawings as appropriate. However, the steps should not be construed restrictively.

In step (a), the discharge energy generation elements 3, the electrode pad, and the wiring are formed on the substrate 1. As the electrode pad, an aluminum electrode pad may be employed. There are no particular limitations regarding the kind of the discharge energy generation elements 3 and the kind of the wiring. Further, there are no particular limitations regarding the method of forming them.

Figure 2A:
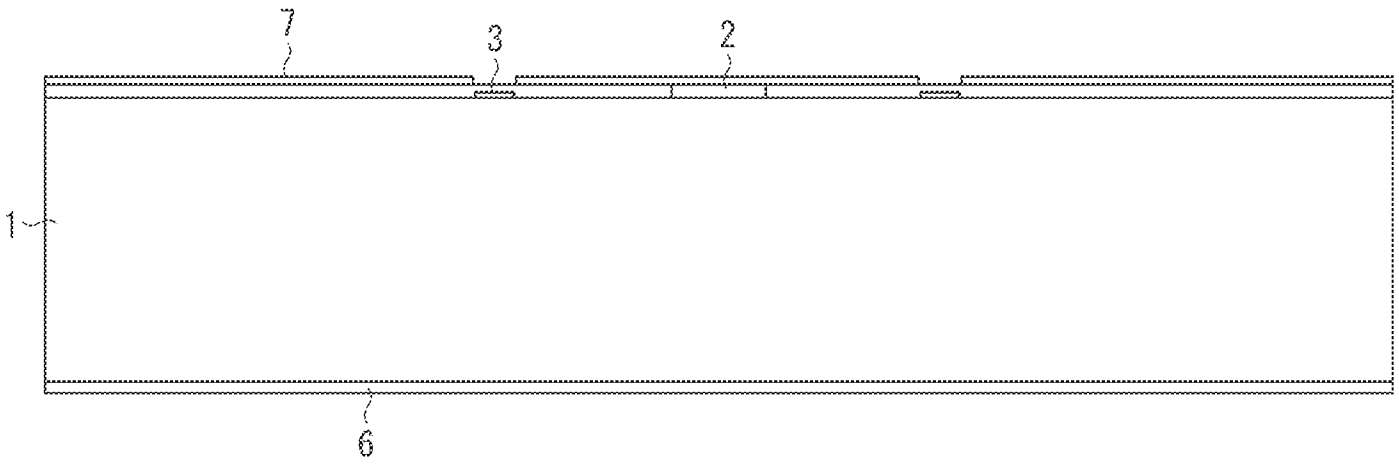
FIGS. 2A, 2B, 2C, and 2D are sectional views each illustrating an example of an ink jet recording head manufacturing method according to an exemplary embodiment of the present invention.

In step (b), the protective film 7 is formed on the substrate 1 so as to protect the wiring (see FIG. 2A). As the material of the protective film 7, it is possible to employ the material as mentioned above. There are no particular limitations regarding the method of forming the protective film 7. It is possible, for example, to employ sputtering or the like. When the substrate 1 is a silicon substrate, the $SiO_2$ film 6 may be formed on the back surface of the substrate 1 after the formation of the protective film 7.

Figure 2B:
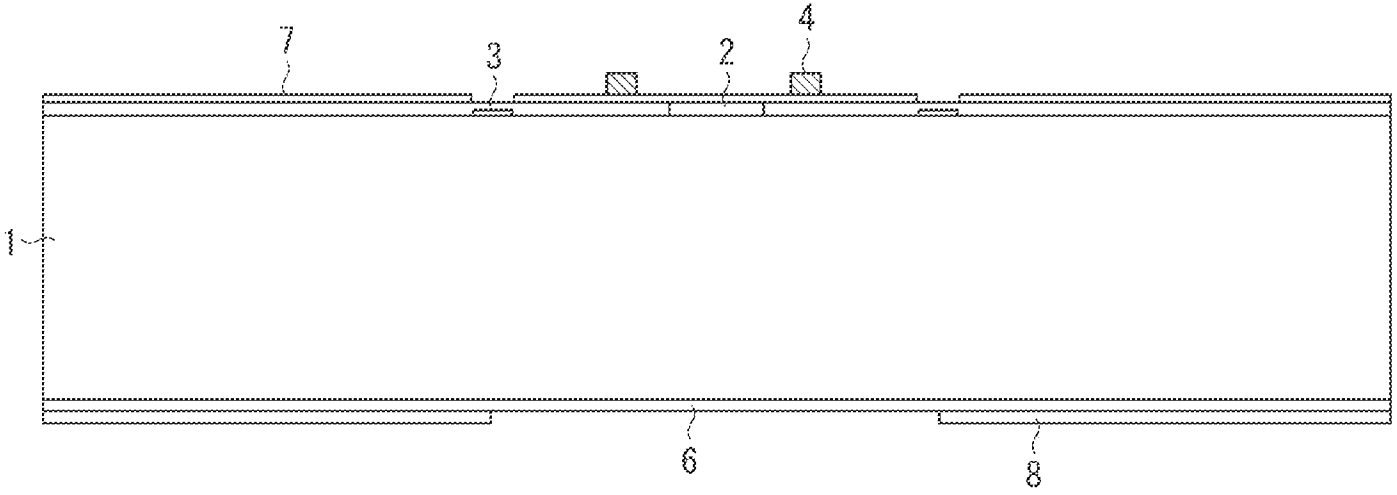

In step (c), the film 4 containing gold is formed on the electrode pad and on the portion constituting the protrusion of the protective film 7 (see FIG. 2B). The film 4 containing gold formed on the portion constituting the protrusion functions as a separation film between the protrusion and the reinforcing rib. In the method according to the present disclosure, it is desirable to simultaneously form the film 4 containing gold on the electrode pad and on the portion constituting the protrusion of the protective film. Since such an arrangement simplifies the operation and reduces the number of operational steps, it becomes possible to perform manufacture with a satisfactory yield. The film 4 containing gold can be formed, for example, by using a gold plating method. More specifically, after forming a seed layer for gold plating film formation and a mold for gold plating film formation, a gold plating layer is formed by using the gold plating method, and the seed layer is removed. Further, after directly performing sputtering with gold and forming the mold, gold may be added by etching for the purpose of reinforcement.

Figure 2C:
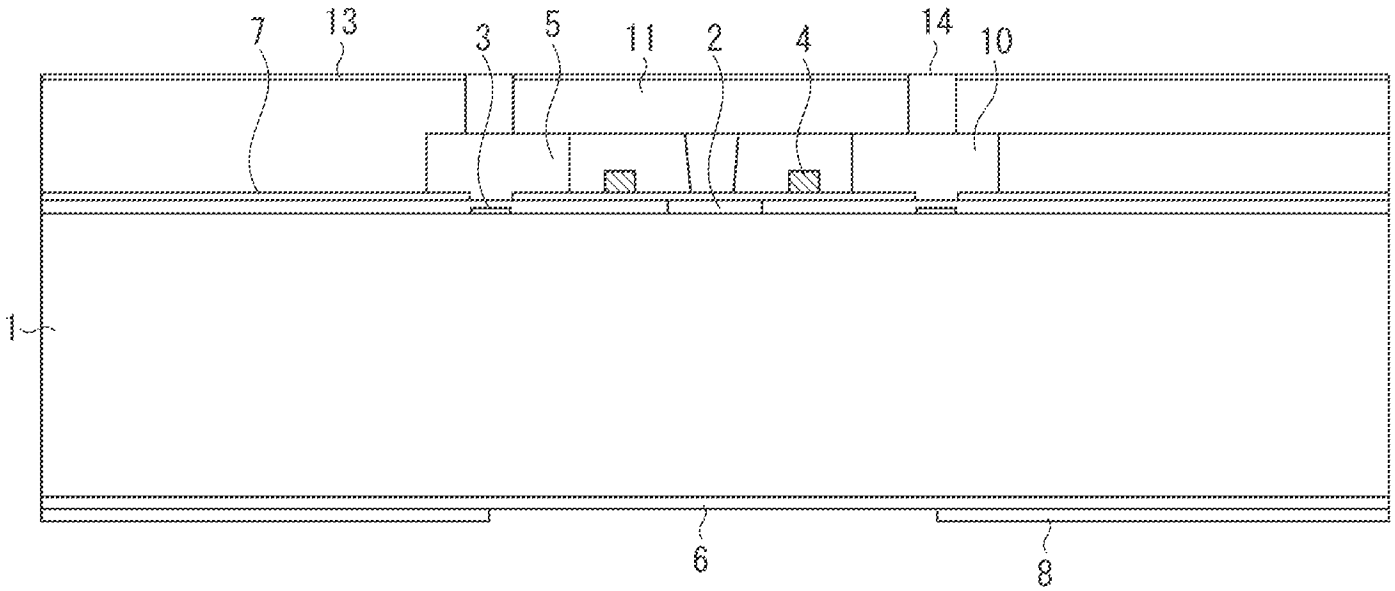

In step (d), the ink discharge port forming member 11 is formed on the substrate 1 (see FIG. 2C). As the material of the ink discharge port forming member 11, it is possible to employ the above-mentioned material. As the method for forming the ink discharge port forming member 11, the following method may be employed. For example, first, a positive type resist is applied to the surface of the substrate 1, and exposure and development is performed thereon. In this way, patterning of a flow path mold member 10 is performed. Next, a photosensitive epoxy resin is applied, exposed, developed, and baked to form the ink discharge port forming member 11. Further, a water repellent material 13 may be applied to the part of the surface of the ink discharge port forming member 11 where the ink discharge ports 14 are formed.

In step (e), the ink supply port 17 is formed in the substrate 1. When the substrate 1 is a silicon substrate, the ink supply port 17 can be formed by anisotropic etching. More specifically, an etching mask layer 8 is formed of polyether amide resin on the back surface of the substrate 1 in advance, and a protective material is applied so as to cover the entire front surface and side surfaces of the substrate 1. After this process, using the etching mask layer 8 as the mask, anisotropic etching is performed on the back surface of the substrate 1 by using an anisotropic etching liquid, such as tetra methyl ammonium hydroxide. In this way, the ink supply port 17 is formed.

Figure 2D:
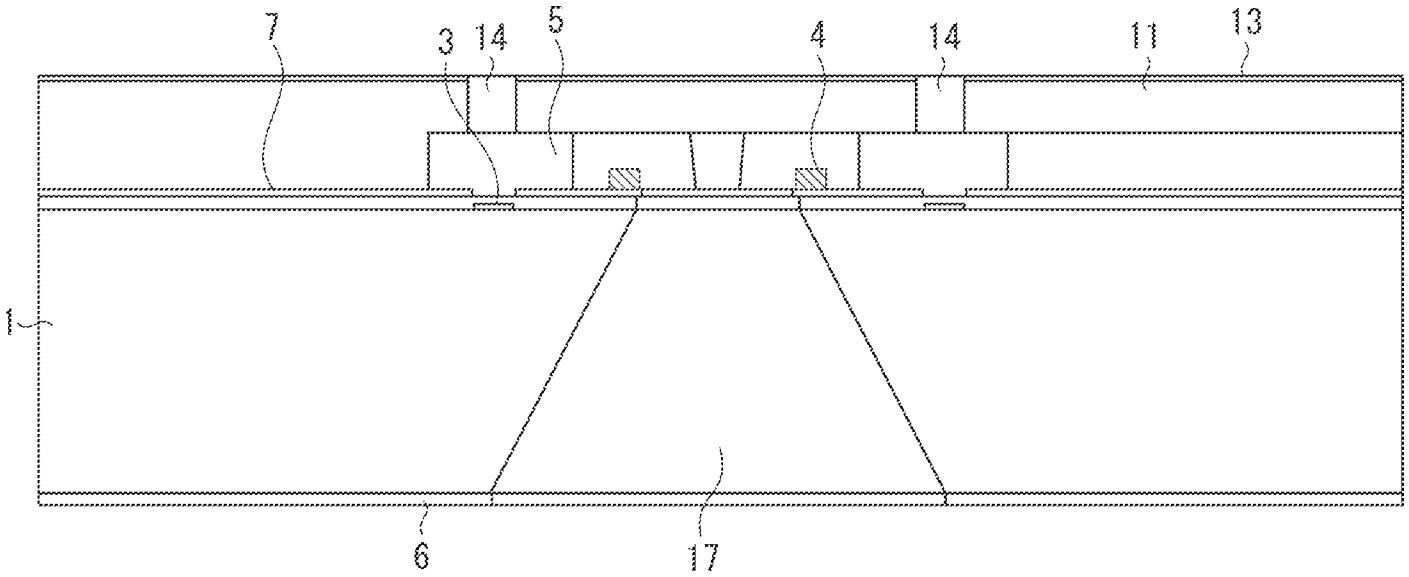

In step (f), the ink flow path 5 is formed (see FIG. 2D). The ink flow path 5 may be formed by immersing the substrate 1 in a solution dissolvable the flow path mold member 10 to dissolve the flow path mold member 10. As needed, the flow path mold member 10 may be dissolved while applying ultrasonic waves to the heated solution.

Exemplary embodiments of the present invention will be described below, which should not be construed restrictively.

In the first exemplary embodiment, an ink jet recording head was produced under the following conditions such as a head drive frequency of 15 kHz, an inter-nozzle pitch of 600 dpi, an ink discharge amount of 5 pl, and a silicon substrate thickness of 625 μm.

First, a silicon substrate 1 on which a plurality of discharge energy generation elements 3 (material: tantalum silicon nitride (TaSiN)), drivers, and logic circuits (not illustrated) are arranged was prepared (see FIG. 2A). At the portion on the substrate 1 where the ink flow path is formed, a heat accumulation layer (not illustrated) is formed. Further, a protective layer 7 (material: SiN) and a sacrifice layer 2 are formed on the substrate 1. An $SiO_2$ film 6 is formed on the back surface of the substrate 1.

Next, a titanium tungsten (TiW) film constituting a diffusion prevention layer, and a seed layer for the gold plating layer were successively formed on the entire surface of the substrate 1. After this, PMER Resist (product name; manufactured by TOKYO OHKA KOGYO Co., Ltd.) constituting the mold of the gold plating film was applied to a thickness of 6 μm, and was baked at 125° C. Then, one-shot exposure was performed by using a projection exposure apparatus of i, h, and g-lines via a photo mask. Development was performed by using NMD-3 (product name; manufactured by TOKYO OHKA KOGYO Co., Ltd.). Further, to improve the wettability of the liquid on the plating surface, ashing processing was performed at 200 W for two minutes, and a gold plating film was formed by using gold plating method. Next, the PMER Resist was removed by using Remover 1112A (product name; manufactured by Rohm & Haas Co.). Then, using the formed gold plating film as a mask, etching was performed on the seed layer by using an etching liquid (product name: AURUM-302; manufactured by KANTO CHEMICAL CO. INC.). Further, etching was performed on the TiW film by using a 31% aqueous solution of hydrogen peroxide. Subsequently, the gold plating was annealed in an oven furnace at 270° for 50 minutes to stabilize its hardness. In the above-described processing, a film formed of gold was formed to a thickness of 5 μm on the aluminum electrode pad on the substrate 1 and on the portion where a reinforcing rib held in close contact with the protrusion was to be formed.

Next, polyether amide resin was applied to each of the front surface and the back surface of the substrate 1 to a thickness of 2 μm by spin coating, and the substrate 1 was baked in the oven furnace at 100° C. for 30 minutes, and at 250° C. for 60 minutes to cure the polyether amide resin. IP5700 (product name; manufactured by TOKYO OHKA KOGYO Co., Ltd.) was applied to each of the front surface and the back surface of the substrate 1 to a thickness of 5 μm by spin coating, and was baked at 90° C. Thereafter, exposure was performed with high accuracy by an i-line stepper using a reticule. Development was performed by using the NMD-3, and dry etching was performed on the exposed portion of the polyether amide resin by the RIE method before removing the resist by using the Remover 1112A. Further, the IP5700 was applied to each of the front surface and the back surface of the substrate 1 to a thickness of 5 μm, and one-shot exposure was performed on the back surface of the substrate 1 by the projection exposure apparatus of the i, h, g-lines using a photo mask. Then, development was performed by using the NMD-3, and the exposed portion of the polyether amide resin was etched by chemical dry etching before removing the resist by using the Remover 1112A. As a result, an intermediate layer (not illustrated) was formed on the front surface of the substrate 1, and an etching mask layer 8 was formed on the back surface of the substrate 1 (see FIG. 2B).

Next, ODUR (product name; manufactured by TOKYO OHKA KOGYO Co., Ltd.), which is a positive type resist, was applied to the front surface of the substrate 1 by spin coating to a thickness of 14 μm. Subsequently, exposure was performed via a photo mask by the projection exposure apparatus of the i, h, g-lines, and development was performed by using MP-5050 (product name; manufactured by Hayashi Pure Chemical Ind. Ltd.) to form a flow path mold member 10. Then, a negative type coating photosensitive resin (product name: Adekaoptomer CR 2.0, which is a photosensitive epoxy resin manufactured by ADEKA CORPORATION) was applied to the substrate 1 on which the flow path mold member 10 has been formed by spin coating to a thickness of 25 μm. Further, a water repellent material was applied thereto to a thickness of 0.5 μm by slide application. Exposure was performed by the i-line stepper via a photo mask, and development was performed by using a mixture liquid composed of 60% by volume of xylene and 40% by volume of methyl isobutyl ketone (MIBK). After this, baking was performed in the oven furnace at 140° C. for 60 minutes, and curing was effected, whereby an ink discharge port forming member 11 having a water repellent material 13 and ink discharge ports 14 is formed (see FIG. 2C).

Next, OBC (product name; manufactured by TOKYO OHKA KOGYO Co., Ltd.), which is a protective material, was applied to the substrate 1 by spin coating to a thickness of 40 μm so that the front and side surfaces of the substrate 1 was entirely covered. After this, an ink supply port 17 was formed in the back surface of the substrate 1 by using the etching mask layer 8 as the mask. More specifically, the back-surface $SiO_2$ film 6 constituting the starting surface for anisotropic etching was etched for 15 minutes by using BHF-U (product name; manufactured by Daikin Industries, Ltd.). Then, etching was performed from the back surface of the silicon substrate 1 along the <111> surface by using TMAH-22 (product name; it is tetra methyl ammonium hydroxide manufactured by KANTO CHEMICAL CO. INC.), as the anisotropic etching liquid, of a temperature-adjusted to 83° C. The etching was performed until the sacrifice layer 2 had been completely removed. The etching time calculated was a time obtained by dividing the thickness (μm) of the substrate 1 by the etching rate (minute). Then, the etching mask layer 8 was removed from the back surface of the substrate 1 by chemical dry etching. Subsequently, the heat accumulation layer near the sacrifice layer 2 was removed by using the BHF-U, and, further, the protective layer 7 near the sacrifice layer 2 was removed by chemical dry etching. And, the OBC, which is a protective material, was removed with xylene. Subsequently, the substrate 1 was immersed in methyl lactate of a temperature-adjusted to 40° C., and, through application of ultrasonic waves of 200 kHz and 200 W, the flow path mold member 10 was eluted from the ink discharge port 14. Thereby, the ink flow path 5 and a foaming chamber were formed. Finally, baking was performed in an oven furnace at 200° C. for 60 minutes to completely cure the ink discharge port forming member 11 (see FIG. 2D). An ink jet recording head was prepared by the above steps.

The ink jet recording head prepared in the present exemplary embodiment exhibits a pattern shape of high precision and reliability. Further, a separation film consisting of gold is formed between the protrusion and the reinforcing rib. Therefore, both of the close-contact property of the ink discharge port forming member 11 and the reliability of the ink flow path 5 are achieved. Cracks on the protrusion can be also prevented from occurring.

In a second exemplary embodiment, in the step of forming a film consisting of gold according to the first exemplary embodiment, sputtering was further performed directly with the gold, and the PMER resist was applied, exposed, developed, and etched in an aqueous solution of iodine potassium iodide. As a result, an ink jet recording head was prepared as in the same way as in first exemplary embodiment, except that gold was added for reinforcement onto the portion where the reinforcing rib held in close contact with the protrusion was to be formed. The ink jet recording head prepared in the present exemplary embodiment exhibits a pattern shape of high precision and reliability. Further, since a separation film consisting of gold is formed between the protrusion and the reinforcing rib, both of the close-contact property of the ink discharge port forming member 11 and the reliability of the ink flow path 5 are achieved. Cracks on the protrusion are also prevented from occurring.

Figure 3A:
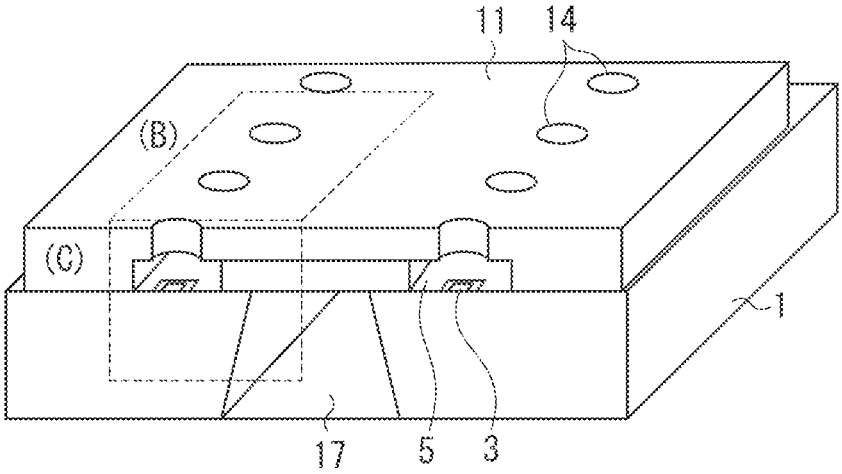
FIGS. 3A, 3B, 3C, and 3D are diagrams each illustrating an ink jet recording head according to a first and a second comparative examples.
Figure 3B:
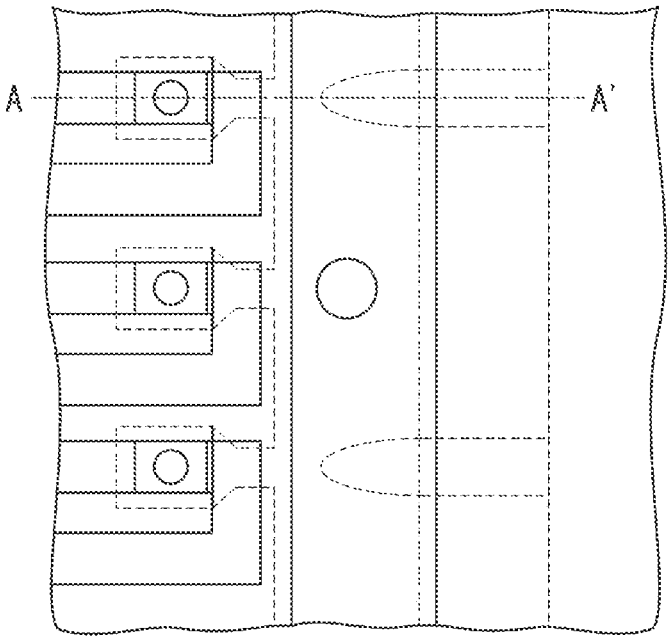
Figure 3C:
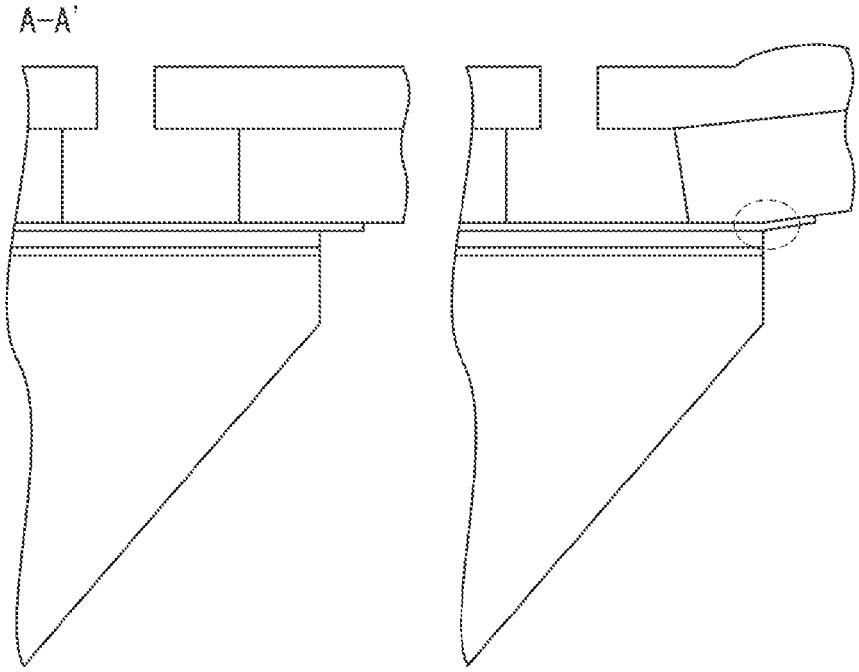
Figure 3D:
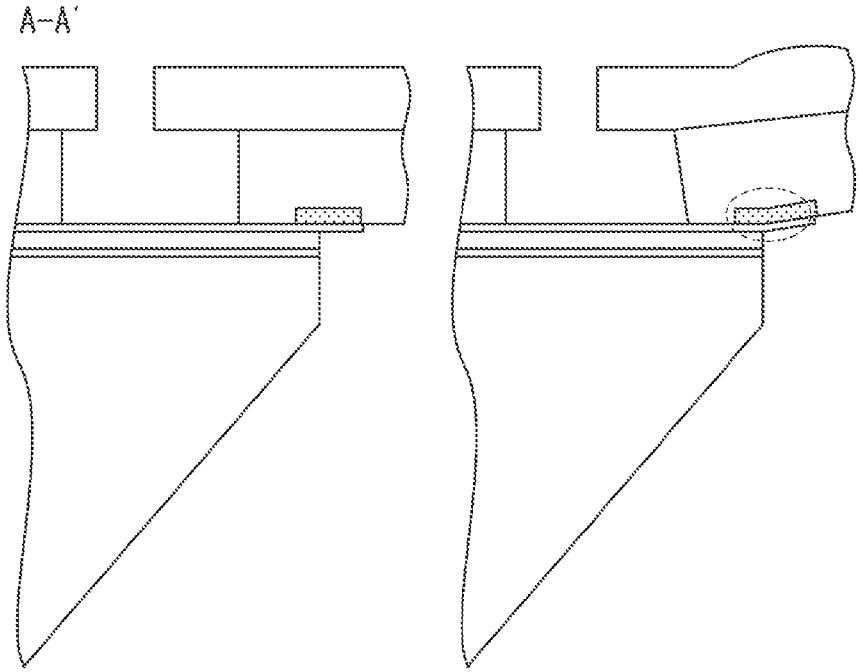

In a first comparative example, an ink jet recording head was prepared in the same way as in the first exemplary embodiment, except that a film consisting of gold was not formed on the portion where the reinforcing rib to be held in close contact with the protrusion was to be formed, in the step of forming the film consisting of gold of the first exemplary embodiment. In the present comparative example, the ink discharge port forming member 11 was directly held in close contact with the protrusion. Therefore, when the ink flow path 5 was filled with ink containing pigment component, the ink discharge port forming member 11 swelled, and cracking and chipping occurred as illustrated in FIG. 3C.

In a second comparative example, SiO sputtering was performed by chemical vapor deposition (CVD) on the portion where the reinforcing rib to be held in close contact with the protrusion was to be formed, and pattering was performed such that an SiO film remained on that portion. An ink jet recording head was prepared in the same way as in the first exemplary embodiment, except that, a film consisting of gold was not formed on the portion where the reinforcing rib to be held in close contact with the protrusion to be formed, in the step of forming the film consisting of gold of the first exemplary embodiment. The SiO film exhibits a satisfactory close-contact property with respect to the ink discharge port forming member 11. Thus, in the present comparative example, when the ink flow path 5 was filled with ink containing pigment component, and the ink discharge port forming member 11 swelled, the SiO film and the ink discharge port forming member 11 were not separated. Consequently, the protrusion was cracked.

According to the ideas presented herein, it is possible to provide an ink jet recording head having a reinforcing rib with high reliability for preventing the protective film protruding toward the ink supply port side from cracking.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-076675 filed Apr. 2, 2013, which is hereby incorporated by reference herein in its entirety.

What is claimed is:

1. An ink jet recording head comprising:

a substrate having a plurality of discharge energy generation elements arranged in two rows and having an ink supply port formed between the two rows of the plurality of discharge energy generation elements;

a protective film provided on the substrate and configured to protect wiring connected to the discharge energy generation elements; and an ink discharge port forming member forming an ink flow path communicating with the ink supply port between the ink discharge port forming member and the substrate and having an ink discharge port communicating with the ink flow path at a position corresponding to each of the discharge energy generation elements, wherein the protective film has a protruding portion, which protrudes from the substrate toward the ink supply port side, wherein the ink discharge port forming member has a beam-like protrusion over the ink supply port between the ink discharge port forming member and the substrate, wherein the beam-like protrusion has a reinforcing rib extending toward the substrate side, and wherein a separation film containing gold is formed at a portion where the protruding portion and the reinforcing rib are held in close contact with each other.

2. The ink jet recording head according to claim 1, wherein the separation film is formed on the protective film and at a tip of the ink supply port.

3. The ink jet recording head according to claim 1, wherein the separation film and the reinforcing rib are separable from each other.

4. The ink jet recording head according to claim 1, wherein the separation film further contains at least one of stainless steel, titanium, and aluminum.

5. The ink jet recording head according to claim 1, wherein the reinforcing rib contains a photosensitive epoxy resin.

6. The ink jet recording head according to claim 1, wherein the protective film contains at least one of silicon nitride, silicon monoxide, and silicon carbide.

7. The ink jet recording head according to claim 1, wherein the thickness of the separation film is at least 2.0 μm or more and up to 5.0 μm or less.

8. An ink jet recording head manufacturing method comprising:

forming a discharge energy generation element, an electrode pad, and wiring on a substrate;

forming a protective film on the substrate to protect the wiring;

forming a film containing gold on the electrode pad and on a portion constituting a protruding portion of the protective film;

forming an ink discharge port forming member on the substrate;

forming an ink supply port in the substrate; and forming an ink flow path.

9. The ink jet recording head manufacturing method according to claim 8, wherein a film containing gold on the electrode pad and on a portion constituting a protruding portion of the protective film is formed simultaneously, in the forming of the film.

10. The ink jet recording head manufacturing method according to claim 8, wherein a film containing gold is formed by using gold plating method, in the forming of the film.

* * * * *